US009867447B1

(12) United States Patent
Kim et al.

(10) Patent No.: US 9,867,447 B1
(45) Date of Patent: Jan. 16, 2018

(54) COMPACT CONTAINER FOR RECEIVING TWO KINDS OF COSMETICS

(71) Applicant: AMOREPACIFIC CORPORATION, Seoul (KR)

(72) Inventors: Jun Young Kim, Seoul (KR); Ju Ho Kim, Seoul (KR)

(73) Assignee: AMOREPACIFIC CORPORATION, Cheonggyecheon-Ro, Jung-Gu, Seoul (KR)

( * ) Notice: Subject to any disclaimer, the term of this patent is extended or adjusted under 35 U.S.C. 154(b) by 0 days.

(21) Appl. No.: 15/232,475

(22) Filed: Aug. 9, 2016

(51) Int. Cl.

| | |
|---|---|
| ***B65D 69/00*** | (2006.01) |
| ***A45D 40/24*** | (2006.01) |
| ***A45D 40/22*** | (2006.01) |
| ***A45D 42/02*** | (2006.01) |
| ***A45D 33/00*** | (2006.01) |

(52) U.S. Cl.
CPC ..... *A45D 40/24* (2013.01); *A45D 33/003* (2013.01); *A45D 40/222* (2013.01); *A45D 42/02* (2013.01); *A45D 2040/223* (2013.01)

(58) Field of Classification Search
CPC .... A45D 40/24; A45D 40/222; A45D 33/003; A45D 42/02; A45D 2040/223
USPC ..... 206/235, 223, 581, 823; 132/300, 293, 132/294, 295, 296, 297, 314, 315
See application file for complete search history.

(56) References Cited

U.S. PATENT DOCUMENTS 1,518,071 A * 12/1924 Jaroslawski-Fioret ..... A45D 33/006 132/295
1,612,409 A * 12/1926 Anderson ..... A45D 33/025 132/295
1,672,270 A * 6/1928 Eriksen ..... A45D 33/006 132/294
1,982,248 A * 11/1934 Gebhardt ..... A44C 5/003 132/296
2,079,305 A * 5/1937 Reilly ..... A45D 33/005 132/296
2,215,480 A * 9/1940 Sampson ..... A45D 33/006 132/306
4,815,608 A * 3/1989 Silberberg ..... A45D 40/22 132/295
6,609,526 B2 * 8/2003 Yuhara ..... A45D 33/003 132/307

(Continued)

*Primary Examiner* — Jacob K Ackun
*Assistant Examiner* — Jenine Pagan
(74) *Attorney, Agent, or Firm* — Lucern, PC; Heedong Chae

(57) ABSTRACT

A compact container for receiving two types of cosmetic materials enables a user to use two types of cosmetic materials in one compact container as a first impregnating member is received in an inner container, and a second impregnating member is received in an inner container lid. The compact container includes an outer container (10) having an open upper portion, an outer container lid (20) coupled to one side of the outer container (10), an inner container (30) having a first receiving space (31) in the outer container (10), and an inner container lid (60) coupled to one side of the inner container (30) and having a second receiving space (65). The second receiving space (65) faces the first receiving space (31), and the second receiving space (65) and the first receiving space (31) are sealed together when the inner container lid (60) is covered on the inner container (30).

24 Claims, 8 Drawing Sheets

(56) References Cited

U.S. PATENT DOCUMENTS

| | | | | |
|---|---|---|---|---|
| 7,047,983 | B2 * | 5/2006 | Manougian | A45D 40/22 132/294 |
| 7,314,051 | B2 * | 1/2008 | Yuhara | A45D 33/006 132/294 |
| 2014/0283870 | A1 * | 9/2014 | Byeon | A45D 33/006 132/315 |

* cited by examiner

PRIOR ART

PRIOR ART

COMPACT CONTAINER FOR RECEIVING TWO KINDS OF COSMETICS

BACKGROUND OF THE INVENTION

1. Field of the Invention

The present invention relates to a compact container for receiving two types of cosmetic materials, and more specifically to a compact container for receiving two types of cosmetic materials, enabling a user to use two types of cosmetic materials contained in one compact container as a first impregnating member is received in an inner container, and a second impregnating member is received in an inner container lid to cover the inner container.

In addition, the present invention relates to a compact container for receiving two types of cosmetic materials, capable of preventing a cosmetic material, which is impregnated in a second impregnating member, and a cosmetic material, which is impregnated in a first impregnating member, from being mixed together to prevent the cosmetic materials having two ingredients from having a chemical reaction because of fixedly coupling a screen fixing the second impregnating member received in an inner container lid and a second fixing member, and capable of easily storing the cosmetic materials.

In addition, the present invention relates to a compact container for receiving two types of cosmetic materials, capable of expressing various colors and various makeup manners as a user can conveniently use two types of cosmetic materials while opening the compact container since a cosmetic material of a first impregnating member is received in an inner container and a cosmetic material of a second impregnating member is received in an inner container cap.

2. Description of the Related Art

Cosmetics refer to articles which are used for a human body in order to add charming of the human body by making the human body clean and beautiful, to change the appearance of the human body into being brighter, to maintain skin or hair in a healthy state, or to enhance the skin or the hair, while exerting slight effects on the human body.

The cosmetics may be mainly classified into basic, color, and functional cosmetics.

The color cosmetics, which are used to beautifully adorn the skin of a user by making the appearance of the user beautiful, are classified into a base makeup, which is used for making a skin color uniform and covering a defect, and a point makeup which is used for partially enhancing a three-dimensional effect of a lip, eyes, or nails. The base makeup includes a makeup base, a foundation and a powder, and the point makeup includes a lipstick, an eye liner, and mascara.

The foundation, which corresponds to the base makeup among the color cosmetics, is classified into solid-type foundation, liquid-type foundation and gel-type foundation according to a type of cosmetic materials. In case of the solid-type foundation, although the solid-type foundation produces an effect of excellently covering a skin, the makeup may be formed into a mass when the makeup is refreshed. In case of the liquid-type foundation, although the liquid-type foundation gives a good close contact feel, the liquid-type foundation may not be long-lasted.

Accordingly, recently, the number of customers, who favor a gel-type foundation having a significantly long-lasting effect and a good close contact feel when applied to a skin, is increased In general, the gel-phase foundation are produced by mixing mutually different materials using an emulsifying agent including a surface active agent, and may be classified into water-in-oil (W/O) cosmetic materials, which are formed by introducing water-based material into oil-based material, and oil-in-water (O/W) cosmetic materials, which are formed by introducing the oil-based material into the water-based material, according to mixing manners.

The W/O cosmetic material, which is formed by introducing water-based material into oil-based material, contains a larger quantity of oil than that of water to represent low absorption into a skin and heavy touch feeling. However, the water-in-oil cosmetic material is longer lasted when comparing with the oil-in-water cosmetic material. Therefore, the cosmetics requiring a long lasting are produced by using the water-in-oil cosmetic materials to increase water resistance against sweat and water.

The water-in-oil cosmetic material is produced with low viscosity in order to compensate for heavy touch feeling and sticky characteristics. However, when a water-in-oil product having low viscosity is stored in a container for a long time during distribution thereof, an aqueous material of an internal phase and an oil material of an external phase may be separated from each other. In this case, a user must shake the container to mix the separated aqueous and oil materials with each other for the use thereof, which causes the inconvenience of use.

In order to solve the above problem, as shown in FIG. 1, an applicant of the present invent has been issued with Korea Patent Registration No. 10-1159877 directed to a product contained in a compact container having an impregnation member impregnated with low-viscosity water-in oil.

However, according to the related art, an impregnating member 1 is formed in a single structure, so that only one type of cosmetic materials may be impregnated in the impregnating member 1. Accordingly, the related art does not satisfy a user who wants various expressions through makeup. In order to use cosmetic materials having at least two colors or different ingredients when making up, the user must prepare different types of cosmetics.

In order to solve the problem, as shown in FIG. 2, the applicant of the present invention has been issued with Korean Utility Model Registration No. 20-0473967 disclosing an impregnating member 2 partitioned into two parts. The two parts of the impregnating member 2 are impregnated with different types of cosmetic materials, respectively, so that a user can simultaneously use two types of cosmetic materials.

However, according to the related art, a user puts cosmetic materials on the skin of the user by directly applying cosmetic materials contained in the impregnating member 2 to a puff. However, when the cosmetic materials are applied to the puff, the cosmetic materials having two ingredients are mixed in the impregnating member 2 to have a chemical reaction to degrade the effects of the cosmetic materials.

In addition, according to the related art, in order to use the cosmetic materials having two ingredients, a user must apply the cosmetic materials to the puff. In order to prevent the cosmetic materials having the two ingredients from being mixed for the use of the cosmetic materials, the user must delicately apply the cosmetic materials to the puff. Accordingly, the user may feel inconvenient in making up through various manners.

SUMMARY OF THE INVENTION

The present invention is made to solve the above problems, and an object of the present invention is to provide a compact container for receiving two types of cosmetic materials, enabling a user to use two types of cosmetic materials contained in one compact container as a first impregnating member is received in an inner container, and a second impregnating member is received in an inner container lid to cover the inner container.

Another object of the present invention is to provide a compact container for receiving two types of cosmetic materials, capable of preventing a cosmetic material, which is impregnated in a second impregnating member, and a cosmetic material, which is impregnated in a first impregnating member, from being mixed together to prevent the cosmetic materials having two ingredients from having a chemical reaction because of fixedly coupling a screen fixing the second impregnating member received in an inner cover lid to a second fixing member, and capable of easily storing the cosmetic materials.

Further, still another object of the present invention is to provide a compact container for receiving two types of cosmetic materials, capable of expressing various colors and various makeup manners as a user can conveniently use two types of cosmetic materials while opening the compact container since a cosmetic material of a first impregnating member is received in an inner container and a cosmetic material of a second impregnating member is received in an inner container cap.

The present invention provides a compact container for receiving two types of cosmetic materials. The compact container includes an outer container (10) having an open 15S upper portion, an outer container lid (20) coupled to one side of the outer container (10), an inner container (30) mounted in the outer container (10) and formed therein with a first receiving space (31), a first impregnating member (40) is received in the first receiving space (31) of the inner container (30), and an inner container lid (60) coupled to one side of the inner container (30) and formed in a lower portion thereof with a second receiving space (65).

A second impregnating member (70) is received in the second receiving space (65) of the inner container lid (60), and fixedly coupled by a second fixing member (90).

In addition, the inner container (30) includes the first receiving space (31), a first inner wall (32) extending upward, and a first outer wall (33) spaced apart outward from the first inner wall (32) by a predetermined distance.

Further, a first fixing member (50) is coupled to an upper portion of the inner container (30) to fix a first impregnating member (40) such that the first impregnating member (40) is prevented from moving out of the inner container (30).

Further, the first impregnating member (40) and the second impregnating member (70) are impregnated with mutually different ingredients or cosmetic materials having different colors.

In addition, there are formed a second inner wall (66) extending upward at an outside of the second receiving space (65) in the inner container lid (60) and a second outer wall (67) spaced apart outward from the second inner wall (66) by a predetermined distance.

In addition, the second fixing member (90) includes a second horizontal extension member (91) extending inward and a second downward extension member (92) extending downward from the second horizontal extension member (91).

Further, a screen (80) is further interposed between the second impregnating member (70) and the fixing member (90).

As described above, according to the compact container for receiving two types of cosmetic materials of the present invention, the first impregnating member is received in the inner container, and the second impregnating member is received in the inner container lid to cover the inner container, so that a user can use two types of cosmetic materials contained in one compact container.

According to the compact container for receiving two types of cosmetic materials of the present invention, the cosmetic material, which is impregnated in the second impregnating member, and the cosmetic material, which is impregnated in the first impregnating member, can be prevented from being mixed together to prevent the cosmetic materials having two ingredients from having the chemical reaction because of fixedly coupling the screen fixing the second impregnating member received in an inner cover lid to the second fixing member, and the cosmetic materials can be easily stored in the cosmetic container.

According to the compact container for receiving two types of cosmetic materials of the present invention, various colors and various makeup manners can be expressed as the user can conveniently use two types of cosmetic materials while opening the compact container since the cosmetic material of the first impregnating member is received in the inner container and the cosmetic material of the second impregnating member is received in the inner container cap.

DETAILED DESCRIPTION OF THE INVENTION

Hereinafter, a compact container for receiving two types of cosmetic materials according to one embodiment of the present invention will be described with reference to accompanying drawings.

Figure 1:
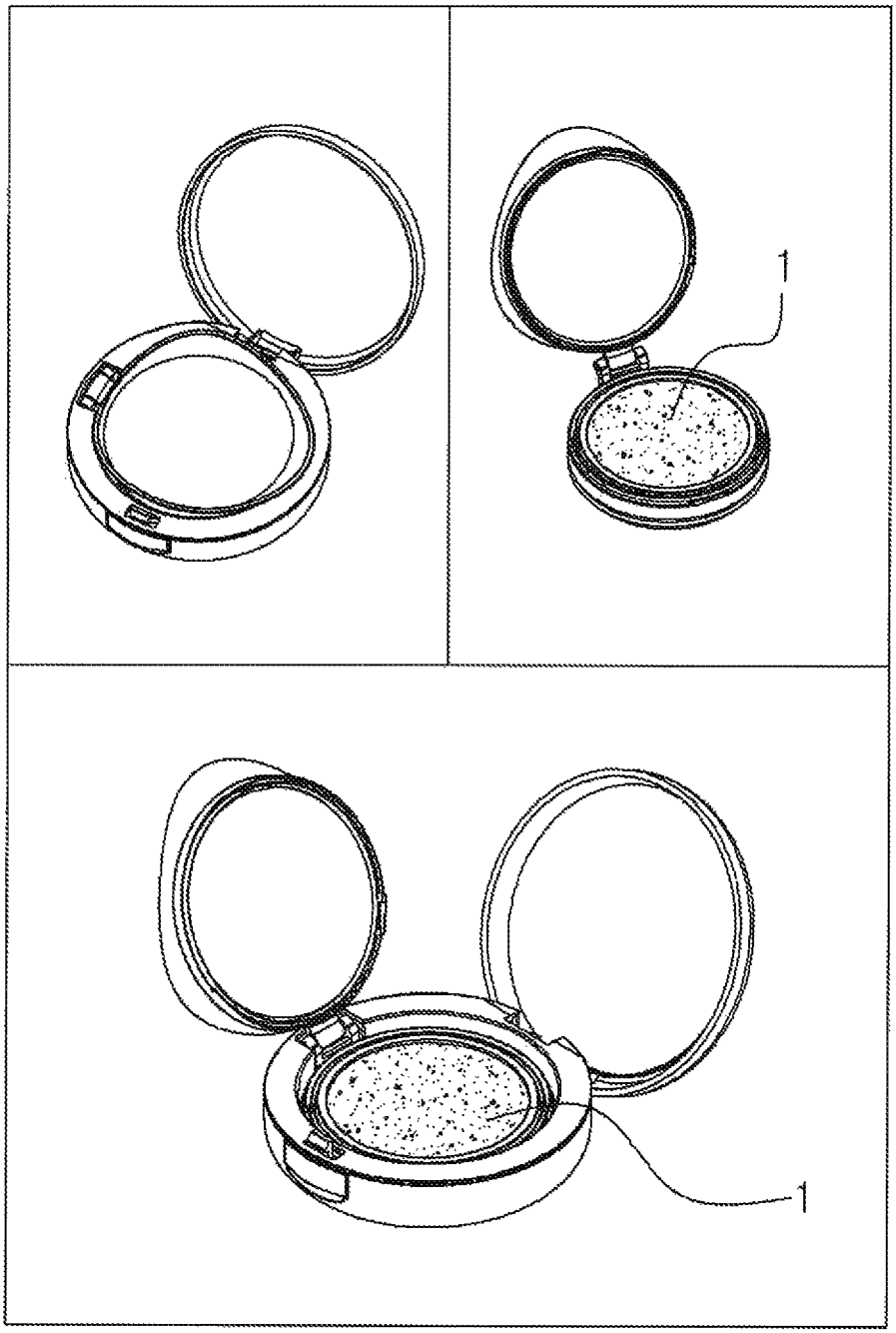
FIG. 1 is a view showing a compact container according to the related art.
Figure 2:
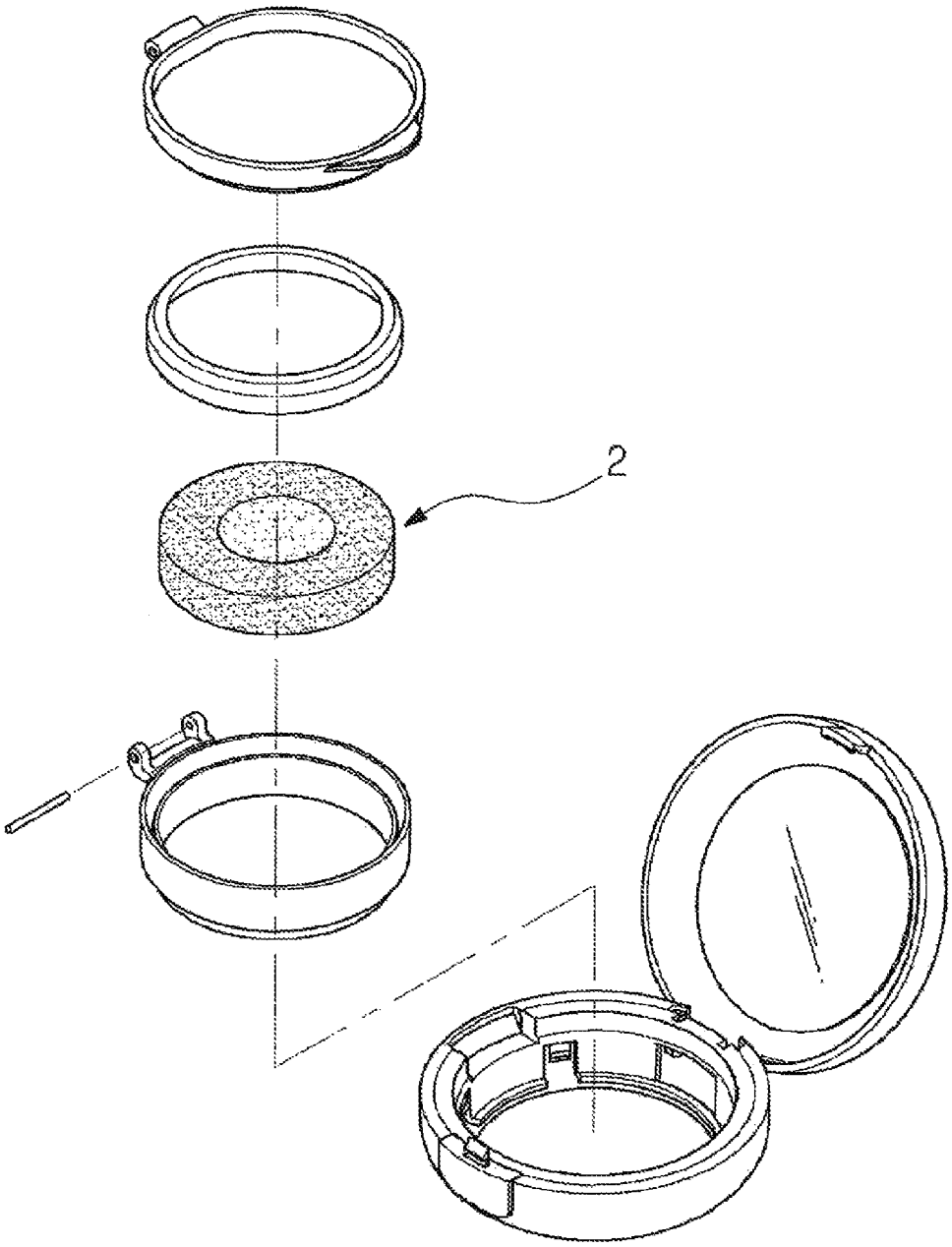
FIG. 2 is an exploded perspective view showing a compact container according to the related art.
Figure 3:
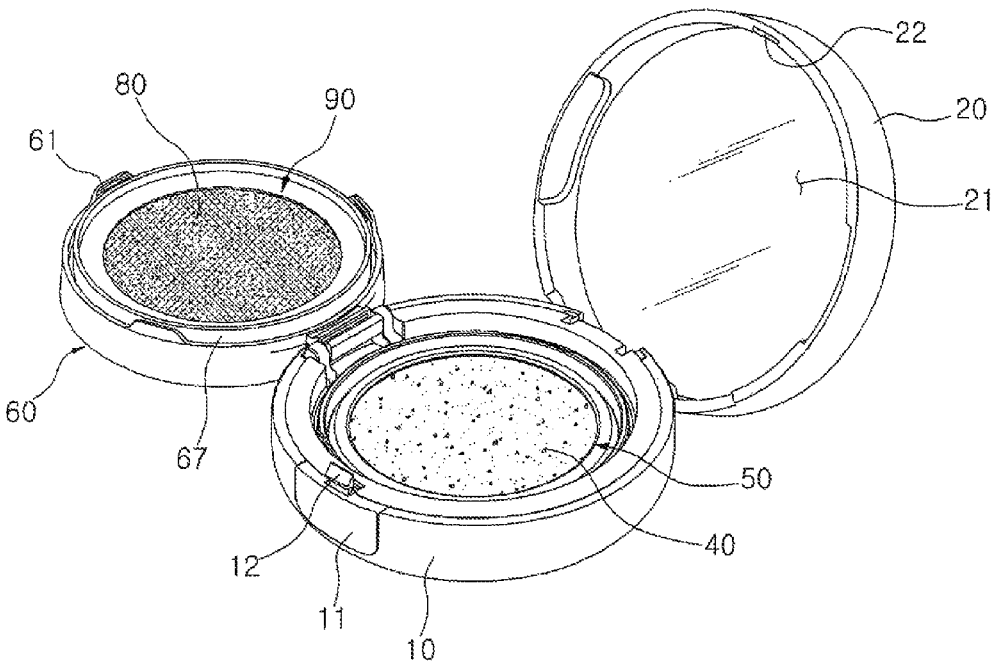
FIG. 3 is a perspective view showing a compact container for receiving two types of cosmetic materials according to one embodiment of the present invention.
Figure 4:
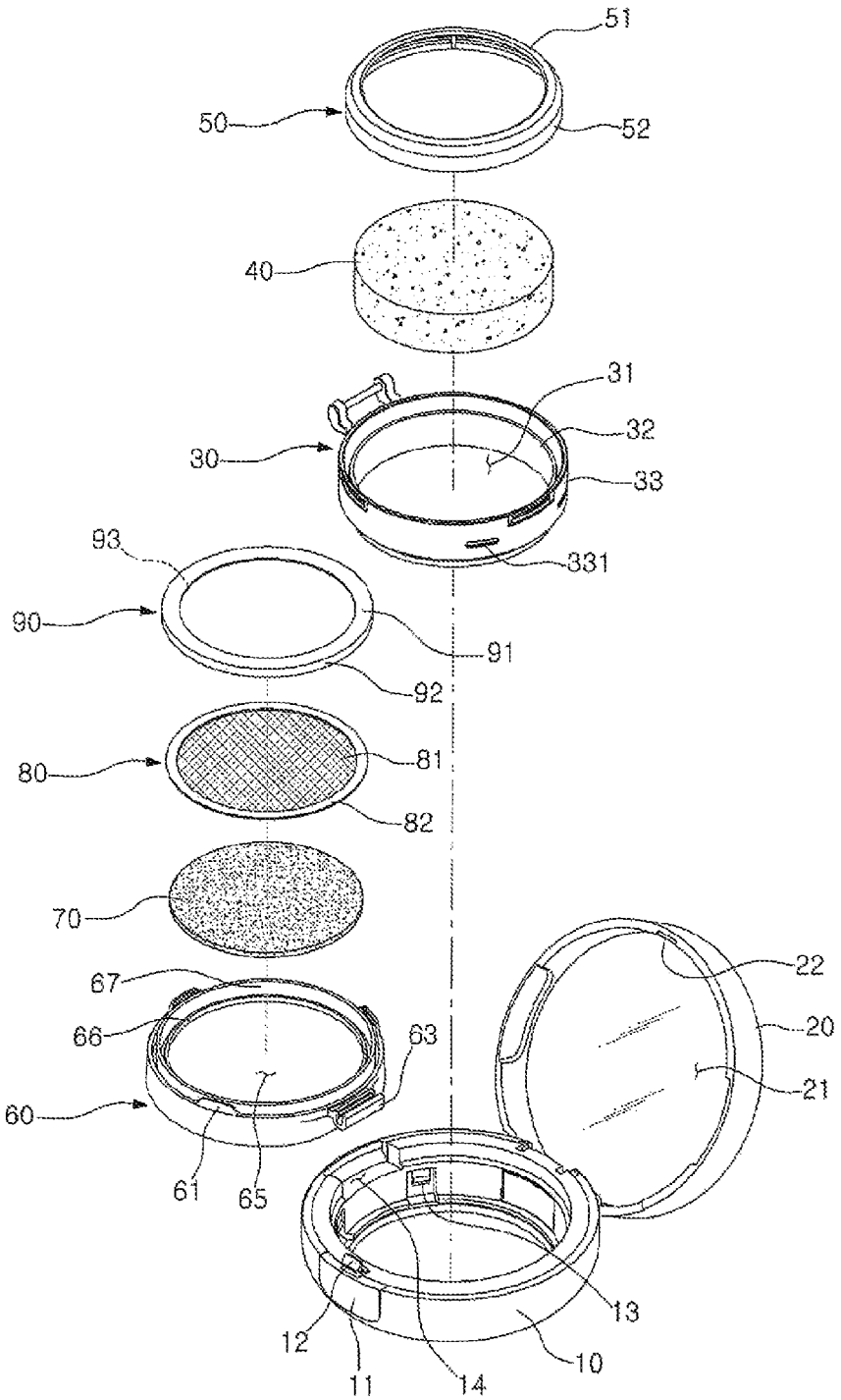
FIG. 4 is an exploded perspective view showing the compact container for receiving two types of cosmetic materials according to one embodiment of the present invention.
Figure 5:
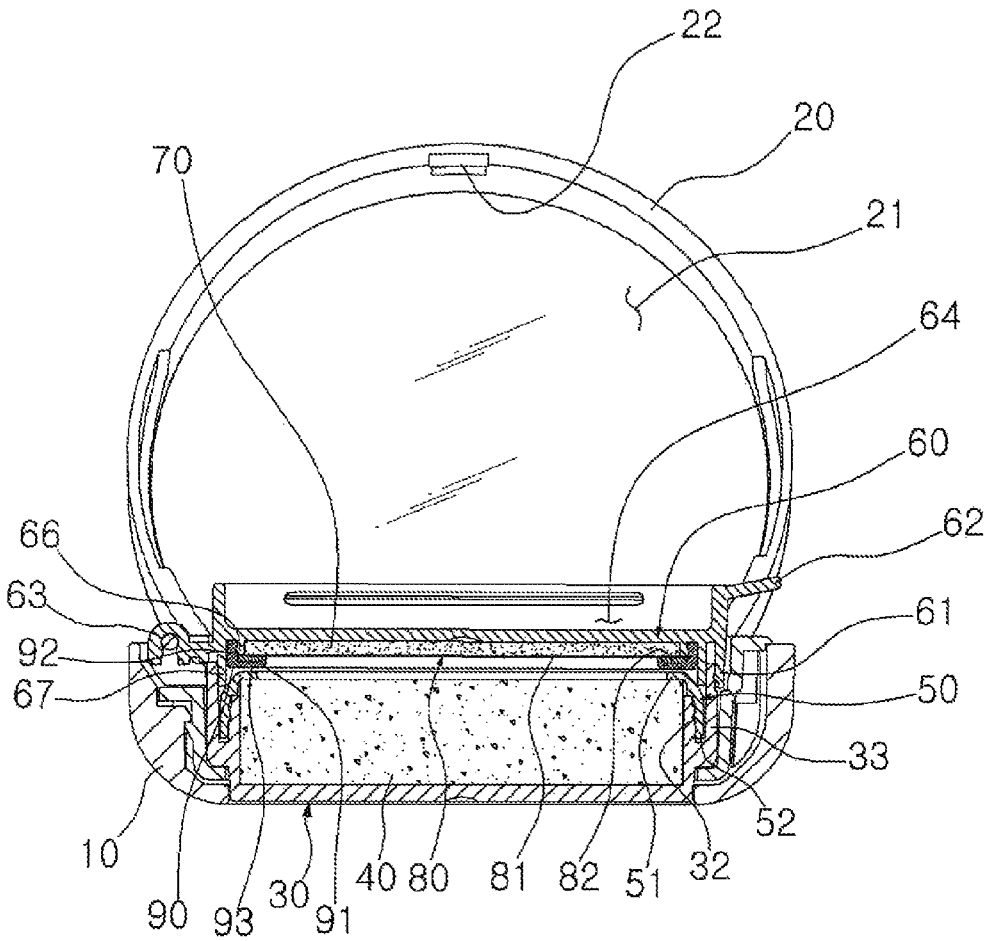
FIG. 5 is a sectional view showing the compact container for receiving two types of cosmetic materials according to one embodiment of the present invention.
Figure 6:
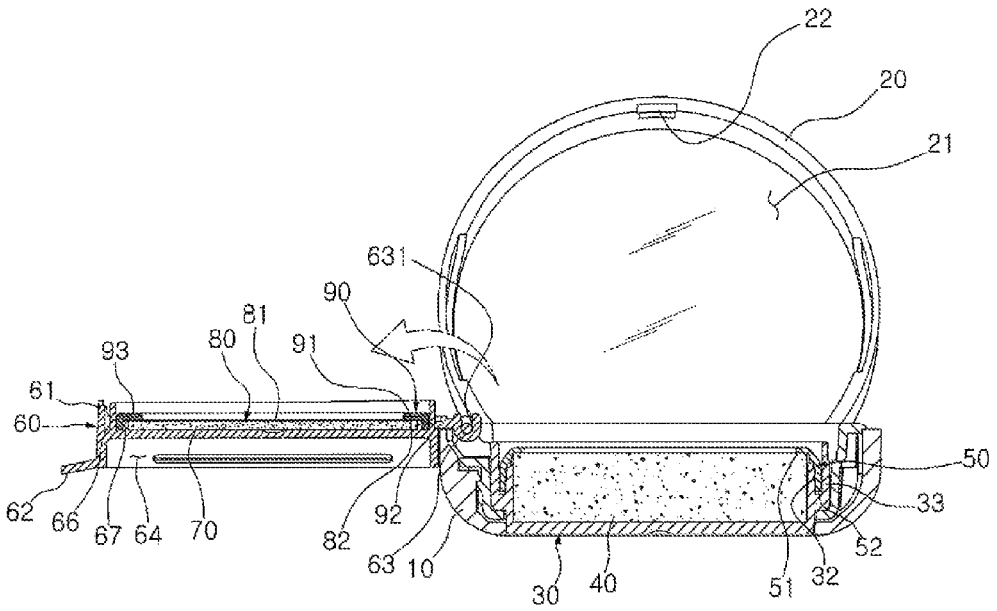
FIG. 6 is a sectional view showing an open state of an inner container lid of the compact container for receiving two types of cosmetic materials according to one embodiment of the present invention.
Figure 7:
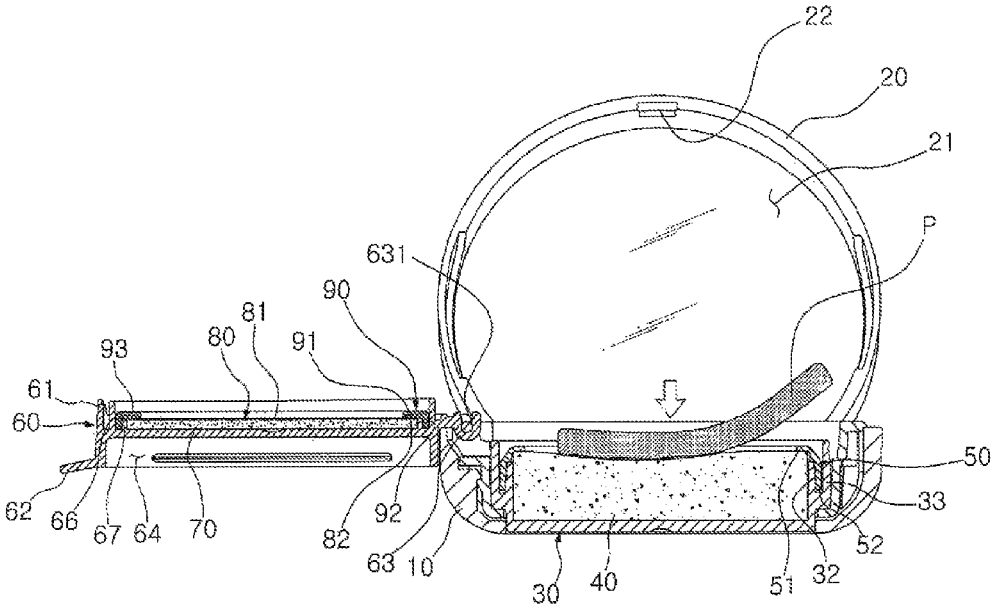
FIG. 7 is a sectional view showing the use state of a first impregnating member of the compact container for receiving two types of cosmetic materials according to one embodiment of the present invention.
Figure 8:
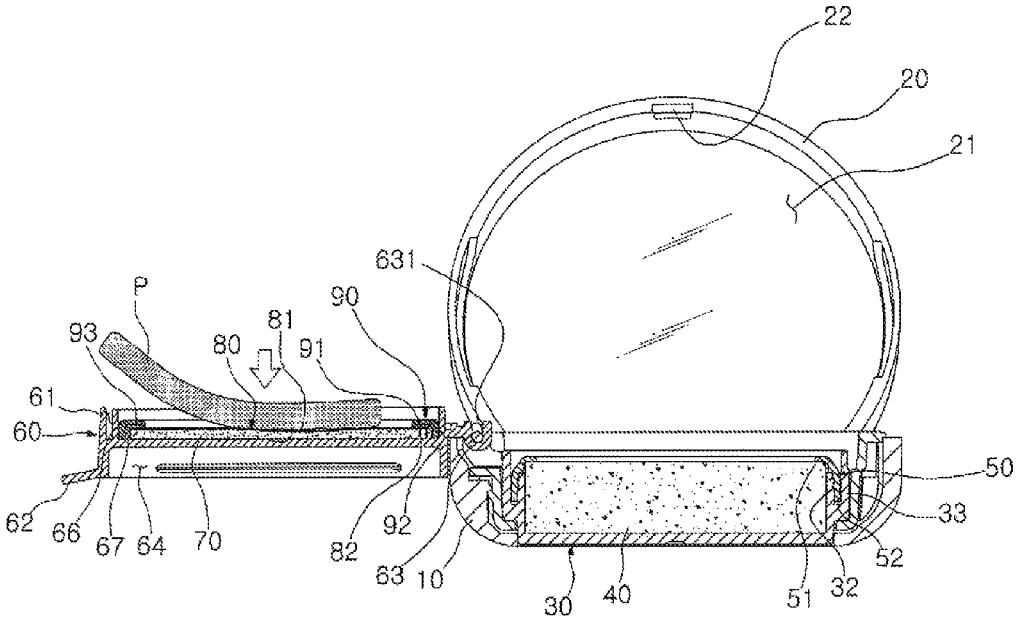
FIG. 8 is a sectional view showing the use state of a second impregnating member of the compact container for receiving two types of cosmetic materials according to one embodiment of the present invention.

FIG. 3 is a perspective view showing a compact container for receiving two types of cosmetic materials according to one embodiment of the present invention. FIG. 4 is an exploded perspective view showing the compact container for receiving two types of cosmetic materials according to one embodiment of the present invention. FIG. 5 is a sectional view showing the compact container for receiving two types of cosmetic materials according to one embodiment of the present invention. FIG. 6 is a sectional view showing an open state of an inner container lid of the compact container for receiving two types of cosmetic materials according to one embodiment of the present invention. FIG. 7 is a sectional view showing the use state of a first impregnating member of the compact container for receiving two types of cosmetic materials according to one embodiment of the present invention. FIG. 8 is a sectional view showing the use state of a second impregnating member of the compact container for receiving two types of cosmetic materials according to one embodiment of the present invention.

The compact container for receiving two types of cosmetic materials according to the present invention includes an outer container 10 having an open upper portion, an outer container lid 20 coupled to one side of the outer container 10, an inner container 30 mounted in the outer container 10 and formed therein with a first receiving space 31, a first impregnating member 40 received in the first receiving space 31 of the inner container 30, and an inner container lid 60 coupled to one side of the inner container 30 and formed in a lower portion thereof with a second receiving space 65.

The outer container 10 includes a pressing button 11 having a locking step 12 and formed at one lateral side thereof, and a hinge formed while facing the pressing button 11 to be hinged with the outer container lid 20. The outer container 10 is formed on an inner circumferential surface thereof with a coupling protrusion 13 and formed in an inner circumference thereof with a hinge part mounting groove 14.

The pressing button 11 may be separated from the locking protrusion 22 of the outer container lid 20 as the locking step 12, which extends upward from the pressing button 11, easily retracts by a pressing operation of a user.

The coupling protrusion 13 is coupled to a coupling groove 331 formed in an outer circumferential surface of a first outer wall 33 of the inner container 30.

The hinge part 34 of the inner container 30 is fitted into the hinge part mounting groove 14.

The outer container lid 20, which covers the upper portion of the outer container 10, is hinged with the outer container 10 to open or close the outer container 10.

The outer container lid 20 has a mirror 21 at an inside thereof, and the mirror 21 allows a user to easily make up using cosmetic materials.

The outer container lid 20 is formed at one side thereof with a locking protrusion 22, and the locking protrusion 22 has a protrusion shape corresponding to the locking step 12 of the outer container 10.

The inner container 30 is mounted inside the outer container 10. The inner container 30 includes the first receiving space 31, a first inner wall 32 extending upward, and a first outer wall 33 spaced apart outward from the first inner wall 32 by a predetermined distance.

A first fixing member 50 is interposed between the first inner wall 32 and the first outer wall 33.

The first outer wall 33 is formed in an outer circumferential surface thereof with the coupling groove 331, and the coupling groove 331 is coupled to the coupling protrusion 13 formed on the inner circumferential surface of the outer container 10 to prevent the inner container 30 and the outer container 10 from being separated from each other.

The hinge part 34 is formed on the outer circumference of the first outer wall 33, and the hinge part 34 is locked with the locking ring 63 formed in the inner container lid 60.

The inner container 30 is provided therein with a first impregnating member 40 impregnated with cosmetic materials, and the first impregnating member 40 includes at least one material selected from the group consisting of butadiene rubber (BR), styrene butadiene rubber (SBR), natural rubber (NR), natural rubber styrene butadiene rubber (NRSBR), acrylonitrile-butadiene rubber (NBR), liquid polyurethane, dry polyurethane, polyether, polyester, polyvinyl chloride vinyl, polyethylene, latex, silicone, polyvinyl alcohol (PVA), nitrile rubber, butyl rubber and neoprene.

The first fixing member 50 is coupled to the inner container 30, and includes a first horizontal extension member 51 extending inward and a first downward extension member 52 extending downward from the first horizontal extension member 51.

The first horizontal extension member 51 is securely mounted on an upper end of the first inner wall 32 of the inner container 30 to prevent the first impregnating member 40 from being separated from the inner container 30.

The first downward extension member 52 is fitted between the first inner wall 32 and the first outer wall 33 of the inner container 30 to prevent the first fixing member 50 from being separated from the inner container 30.

The inner container lid 60 is coupled to an upper portion of the inner container 30.

The inner container lid 60 has a sealing member 61 extending from a lower end thereof, and the sealing member 61 is coupled to the first outer wall 33 of the inner container 30 as shown in FIG. 5 to enhance the air tightness of the inner container 60.

The inner container lid 60 is formed on one lateral side thereof with a knob 62 for facilitating an opening/closing operation.

The inner container lid 60 is formed on one side thereof with a locking ring 63, and the locking ring 63 is coupled to the hinge part 34 formed on one side of the inner container 30 through a latching scheme.

As shown in FIG. 5, the locking ring 63 is formed on an inner circumferential surface thereof with an anti-separation protrusion 631, and the anti-separation protrusion 631 prevents the locking protrusion 61 from being separated from the locking ring 63.

In addition, the inner container lid 60 is formed in a top surface thereof with a puff mounting groove 64 to store a puff P.

The inner container lid 60 is formed at a lower portion thereof with the second receiving space 65 and includes a second inner wall 66 extending downward from the second receiving space 65 and a second outer wall 67 spaced apart outward from the second inner wall 66 by a predetermined distance.

A second fixing member 90 is fitted between the second inner wall 66 and the second outer wall 67.

A second impregnating member 70 impregnated with cosmetic materials is provided in the second receiving space 65.

As shown in FIG. 5, the second receiving space 65 faces the first receiving space 31, and the second receiving space 65 and the first receiving space 31 are sealed together when the inner container lid 60 is covered on the inner container 30.

Since the cosmetic material impregnated into the second impregnating member 70 is different from the cosmetic materials impregnated into the first impregnating member 40 of the inner container 30, a user can conveniently use two types of cosmetic materials while opening the compact container according to the present invention.

Similarly to the first impregnating member 40, the second impregnating member 70 includes at least one material selected from the group consisting of butadiene rubber (BR), styrene butadiene rubber (SBR), natural rubber (NR), natural rubber styrene butadiene rubber (NRSBR), acrylonitrile-butadiene rubber (NBR), liquid polyurethane, dry polyurethane, polyether, polyester, polyvinyl chloride vinyl, polyethylene, latex, silicone, polyvinyl alcohol (PVA), nitrile rubber, butyl rubber and neoprene.

The second impregnating member 70 is further formed thereon with a screen 80, and the screen 80 includes a mesh part 81 and a frame 82 forming the rim of the mesh part 81.

The screen 80 covers an upper portion of the second impregnating member 70 to prevent the second impregnating member 70 from being sagged downward even if the second impregnating member 70 is located downward as shown in FIG. 5, and to prevent cosmetic materials from being mixed together as the second impregnating member 70 makes contact with the first impregnating member 40.

The second fixing member 90 is interposed between the second inner wall 66 and the second outer wall 67 of the inner container lid 60, and includes a second horizontal extension member 91 extending inward and a second downward extension member 92 extending downward from the second horizontal extension member 91.

The second horizontal extension member 91 is securely mounted on a lower end of the second inner wall 66 of the inner container lid 60 to prevent the screen 80 from being separated from the second impregnating member 70.

The second horizontal extension member 91 is formed in an inner part thereof with a frame mounting groove 93, and the frame 82 of the screen 80 is fitted into the frame mounting groove 93 to prevent the screen 80 from being separated from the second fixing member 90.

The second downward extension member 92 is fitted between the second inner wall 66 and the second outer wall 67 of the inner container lid 60 to prevent the second fixing member 90 from being separated from the inner container lid 60.

Hereinafter, the assembling method and the use state of the compact container for receiving two types of cosmetic materials according to one embodiment of the present invention will be described.

According to the present invention, after coupling the outer container lid 20 to one side of the outer container 10 having the open upper portion, the first impregnating member 40 impregnated with the cosmetic materials is mounted in the inner container 30. Then, the first fixing member 50 is coupled to the inner container 30 to prevent the first impregnating member 40 from being separated from the inner container 30.

Thereafter, the second impregnating member 70 impregnated with the cosmetic materials is mounted in the second receiving space 65 formed in the lower portion of the inner container lid 60.

In this case, since the cosmetic materials impregnated into the second impregnating member 70 is different from the cosmetic materials impregnated into the first impregnating member 40, the compact container according to the present invention may receive both of two types of cosmetic materials.

Then, after mounting the screen 80 on the second impregnating member 70, the second fixing member 90 is coupled to the inner container lid 60 to prevent the second impregnating member 70 and the screen 80 from being separated from the inner container lid 60.

Thereafter, the inner container lid 60 is coupled to the inner container 30, which finishes the assembling of the compact container.

In order to use the contents in the compact container having two types of cosmetic materials, which has been assembled through the above method, a user opens the inner container lid 60 as shown in FIG. 6.

Thereafter, as shown in FIG. 7, when the user wants to use the cosmetic materials impregnated into the first impregnating member 40 by pressing the first impregnating member 40 with the puff P while using different cosmetic materials. As shown in FIG. 8, the user may use the cosmetic materials impregnated into the second impregnating member 70 received in the lower portion of the inner container lid 60 by pressing the screen 80.

According to compact container according to the present invention, since the first impregnating member 40 and the second impregnating member 70 are impregnated with mutually different cosmetic materials, a user can conveniently use two types of cosmetic materials while opening the compact container.

As described above, although a cosmetic container for receiving two types of cosmetic materials according to one embodiment of the present invention has been described for the illustrative purpose, the present invention is not limited thereto. Thus, it should be understood that numerous other modifications and embodiments can be devised by those skilled in the art within the spirit and scope of the present invention and they will fall within the scope of the present invention.

What is claimed is:

1. A compact container for receiving two types of cosmetic materials, the compact container comprising:

an outer container (10) having an open upper portion;

an outer container lid (20) coupled to one side of the outer container (10);

an inner container (30) mounted in the outer container (10) and formed therein with a first receiving space (31); and an inner container lid (60) coupled to one side of the inner container (30), the inner container lid (60) having a second receiving space (65) at a lower portion therein a puff mounting recess (64) at an upper portion therein, and a sealing member (61) extending from a lower end thereof, wherein the sealing member (61) and an inner wall of the inner container lid (60) form a recess to receive a first outer wall (33) of the inner container (30), and the coupling of the sealing member (61) and the first outer wall (33) enhances airtightness of the inner container lid (60) in a closed state, wherein, when the compact container is closed, the second receiving space (65) faces the first receiving space (31), and the second receiving space (65) and the first receiving space (31) are sealed together.

2. The compact container of claim 1, wherein a first impregnating member (40) is received in the first receiving space (31) of the inner container (30).

3. The compact container of claim 1, wherein the inner container (30) includes the first receiving space (31), a first inner wall (32) extending upward, and a first outer wall (33) spaced apart outward from the first inner wall (32) by a predetermined distance.

4. The compact container of claim 2, wherein a first fixing member (50) is coupled to an upper portion of the inner container (30) to fix the first impregnating member (40) such that the first impregnating member (40) is prevented from moving out of the inner container (30).

5. The compact container of claim 1, further comprising a second inner wall (66) extending downward at an outside of the second receiving space (65) in the inner container lid (60) and a second outer wall (67) spaced apart outward from the second inner wall (66) by a predetermined distance.

6. A compact container for receiving two types of cosmetic materials, the compact container comprising:

an outer container (10) having an open upper portion;

an outer container lid (20) coupled to one side of the outer container (10);

an inner container (30) mounted in the outer container (10) and formed therein with a first receiving space (31); and an inner container lid (60) coupled to one side of the inner container (30), the inner container lid (60) having a second receiving space (65) at a lower portion therein, and a sealing member (61) extending from a lower end thereof, wherein the sealing member (61) and an inner wall of the inner container lid (60) form a recess to receive a first outer wall (33) of the inner container (30), and the coupling of the sealing member (61) and the first outer wall (33) enhances airtightness of the inner container lid (60) in a closed state, wherein a second impregnating member (70) is received in the second receiving space (65) of the inner container lid (60), and fixedly coupled by a second fixing member (90).

7. The compact container of claim 6, wherein a first impregnating member (40) is received in the first receiving space (31) of the inner container (30).

8. The compact container of claim 6, wherein the inner container (30) includes the first receiving space (31), a first inner wall (32) extending upward, and a first outer wall (33) spaced apart outward from the first inner wall (32) by a predetermined distance.

9. The compact container of claim 7, wherein a first fixing member (50) is coupled to an upper portion of the inner container (30) to fix the first impregnating member (40) such that the first impregnating member (40) is prevented from moving out of the inner container (30).

10. The compact container of claim 6, further comprising a second inner wall (66) extending downward at an outside of the second receiving space (65) in the inner container lid (60) and a second outer wall (67) spaced apart outward from the second inner wall (66) by a predetermined distance.

11. The compact container of claim 6, wherein the second fixing member (90) includes a second horizontal extension member (91) extending inward and a second downward extension member (92) extending downward from the second horizontal extension member (91).

12. The compact container of claim 6, further comprising a screen (80) interposed between the second impregnating member (70) and the fixing member (90).

13. A compact container for receiving two types of cosmetic materials, the compact container comprising:

an inner container (30) formed therein with a first receiving space (31); and an inner container lid (60) coupled to one side of the inner container (30), the inner container lid (60) having a second receiving space (65) at a lower portion therein, a puff mounting recess (64) at an upper portion therein, and a sealing member (61) extending from a lower end thereof, wherein the sealing member (61) and an inner wall of the inner container lid (60) form a recess to receive a first outer wall (33) of the inner container (30), and the coupling of the sealing member (61) and the first outer wall (33) enhances airtightness of the inner container lid (60) in a closed state, wherein, when the compact container is closed, the second receiving space (65) faces the first receiving space (31), and the second receiving space (65) and the first receiving space (31) are sealed together.

14. The compact container of claim 13, wherein a first impregnating member (40) is received in the first receiving space (31) of the inner container (30).

15. The compact container of claim 13, wherein the inner container (30) includes the first receiving space (31), a first inner wall (32) extending upward, and a first outer wall (33) spaced apart outward from the first inner wall (32) by a predetermined distance.

16. The compact container of claim 14, wherein a first fixing member (50) is coupled to an upper portion of the inner container (30) to fix the first impregnating member (40) such that the first impregnating member (40) is prevented from moving out of the inner container (30).

17. The compact container of claim 13, further comprising a second inner wall (66) extending downward at an outside of the second receiving space (65) in the inner container lid (60) and a second outer wall (67) spaced apart outward from the second inner wall (66) by a predetermined distance.

18. A compact container for receiving two types of cosmetic materials, the compact container comprising:

an inner container (30) formed therein with a first receiving space (31); and an inner container lid (60) coupled to one side of the inner container (30), the inner container lid (60) having a second receiving space (65) at a lower portion therein, and a sealing member (61) extending from a lower end thereof, wherein the sealing member (61) and an inner wall of the inner container lid (60) form a recess to receive a first outer wall (33) of the inner container (30), and the coupling of the sealing member (61) and the first outer wall (33) enhances airtightness of the inner container lid (60) in a closed state, wherein a second impregnating member (70) is received in the second receiving space (65) of the inner container lid (60), and fixedly coupled by a second fixing member (90).

19. The compact container of claim 18, wherein a first impregnating member (40) is received in the first receiving space (31) of the inner container (30).

20. The compact container of claim 18, wherein the inner container (30) includes the first receiving space (31), a first inner wall (32) extending upward, and a first outer wall (33) spaced apart outward from the first inner wall (32) by a predetermined distance.

21. The compact container of claim 19, wherein a first fixing member (50) is coupled to an upper portion of the inner container (30) to fix the first impregnating member (40) such that the first impregnating member (40) is prevented from moving out of the inner container (30).

22. The compact container of claim 18, further comprising a second inner wall (66) extending downward at an outside of the second receiving space (65) in the inner container lid (60) and a second outer wall (67) spaced apart outward from the second inner wall (66) by a predetermined distance.

23. The compact container of claim 18, wherein the second fixing member (90) includes a second horizontal extension member (91) extending inward and a second downward extension member (92) extending downward from the second horizontal extension member (91).

24. The compact container of claim 18, further comprising a screen (80) interposed between the second impregnating member (70) and the fixing member (90).

* * * * *